United States Patent [19]

Amann

[11] Patent Number: 4,457,255

[45] Date of Patent: Jul. 3, 1984

[54] SKI WAXING MACHINE

[76] Inventor: Peter M. Amann, Magnusstrasse 25, D-8960 Kempten-St. Mang, Fed. Rep. of Germany

[21] Appl. No.: 516,958

[22] Filed: Jul. 25, 1983

[30] Foreign Application Priority Data

Jul. 27, 1982 [DE] Fed. Rep. of Germany ..... 3227922

[51] Int. Cl.[3] ..... B05C 1/02

[52] U.S. Cl. ..... 118/72; 118/244; 118/242

[58] Field of Search ..... 118/72, 242, 500, 58, 118/252, 244

[56] References Cited

U.S. PATENT DOCUMENTS

| | | | |
|---|---|---|---|
| 2,537,511 | 1/1951 | Coulombe | 118/72 X |
| 3,045,639 | 7/1962 | Kurlander et al. | 118/72 X |
| 3,136,659 | 6/1964 | Walker et al. | 118/72 X |
| 3,425,394 | 2/1969 | Rey | 118/72 X |

*Primary Examiner*—John P. McIntosh

*Attorney, Agent, or Firm*—Kuhn, Muller and Bazerman

[57] ABSTRACT

A ski waxing machine comprises a housing with an oblong opening in the upper wall. The length and the width of the opening corresponds to the length and the width of a pair of skis arranged side by side. A plurality of supporting elements are arranged within the housing and project into the opening. The skis secured on the feet of a skier are supported by the supporting elements. A guide block can be reciprocated within the housing carrying waxing devices, which project upwards into the opening. The supporting elements can be temporarily removed out of the moving path of the guide block and waxing devices upon approach thereof and are automatically reset into the supporting position after the guide block has passed.

10 Claims, 5 Drawing Figures

SKI WAXING MACHINE

The invention relates to a ski waxing machine comprising an oblong housing, supporting elements arranged within said housing supporting the skis while being worn by the user, means for cleaning snow from the running surfaces of the skis, means for conditioning the running surfaces for receiving wax and means for applying a coating of wax, said means arranged in the housing, driving means for causing a relative movement in the longitudinal direction of the skis between said skis and at least said means for applying a wax coating.

A known ski waxing machine of this kind is shown in U.S. Pat. No. 30,45,639. The means for treating the running surfaces of the skis have fixed positions in the housing. The skier moves or must be moved along the housing. Due to this movement of the skis they can tilt, which results in an uneven wax coating. Moreover the housing must have a remarkable length or at least an inlet run and an outlet run at the ends of the housing. Last not least the fresh wax coating is partly removed from the running surface due to the continuous movement of the skis. Therefore it is an object of the invention to provide a waxing machine which avoids the disadvantages mentioned above.

It is a further object to provide a waxing machine which operates without moving the skier over the housing.

One further object is to provide a waxing machine, the housing of which having only a small length substantially only as great as the ski-length without the necessity providing opposite inlet and outlet runs adjacent the housing and in the longitudinal direction thereof.

Last not least it is an object of the invention to provide the driving means in the above mentioned known machine comprising a guide block guided in the longitudinal direction within the housing for a reciprocating motion, at least said means for applying wax mounted at said guide block, said supporting elements provided in the moving path of the guide block and movably arranged between a supporting position inside of the moving path of the guide block and a rest position outside thereof respectively the supporting elements moved into their rest positions upon approach of the guide block respectively.

Further objects and features of the present invention will become apparent from the following specification and claims taken together with the accompanying drawings, in which:

Figure 1:
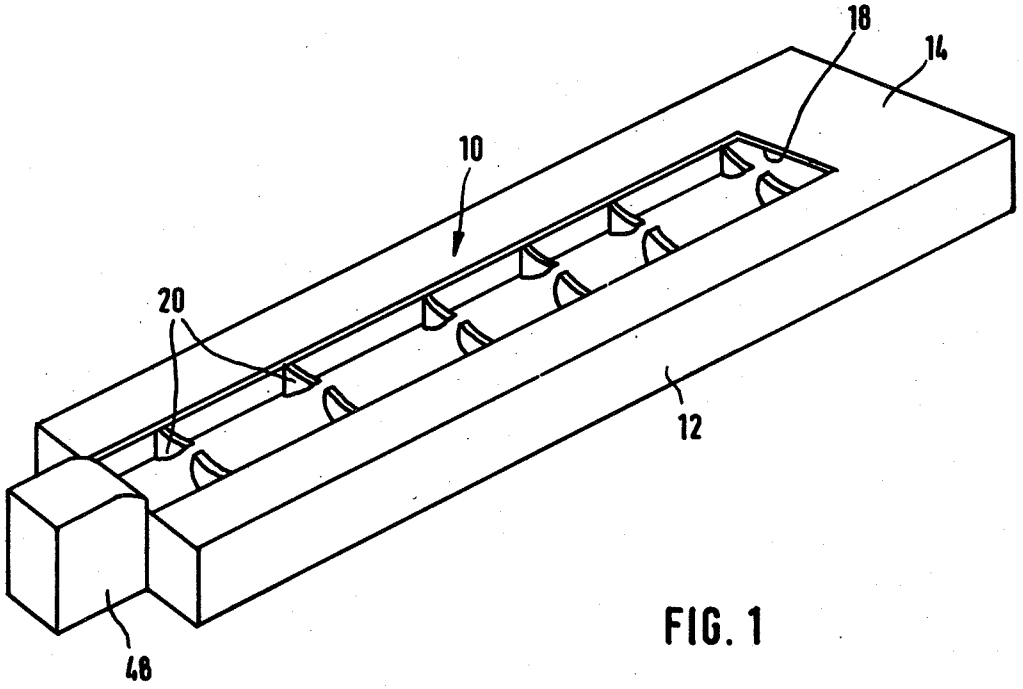
FIG. 1 is a perspective view of a waxing machine.

An oblong housing 10 comprises four vertical side walls 12, an upper wall 14 and a lower wall 16. The upper wall 14 has a rectangular oblong opening 18, the length of which corresponds substantially to the greatest length of common skis and the width of which is only somewhat larger than twice the ski width. Two rows of supporting elements 20 are arranged within the housing. Each row supports one ski S. Each row consists of at least four supporting elements. The interspace between the supporting elements in the central region is smaller than that between the supporting elements at the ends of the housing.

Figure 2:
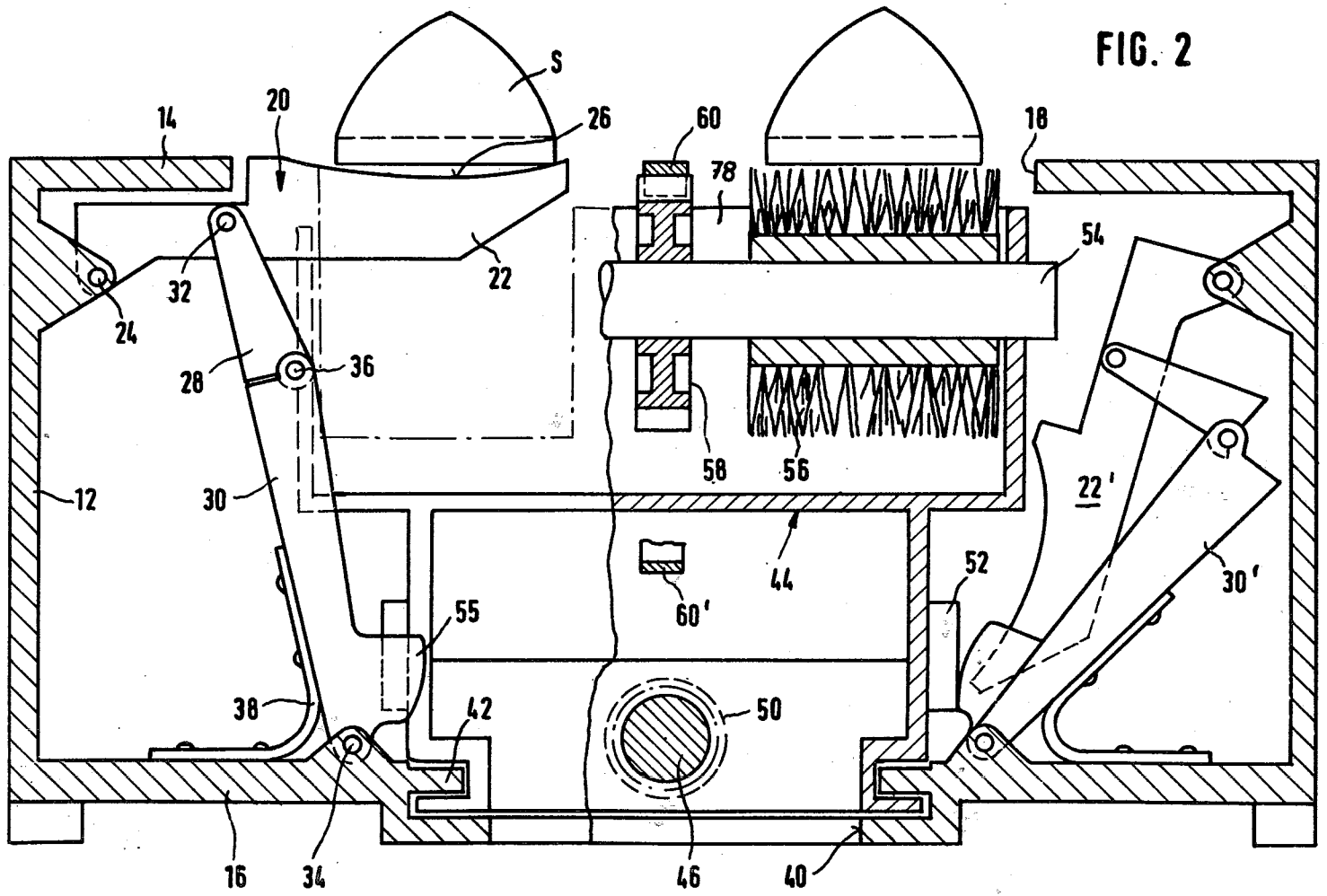
FIG. 2 is a cross-sectional view of one embodiment of the waxing machine.

With respect to FIG. 2 each supporting element comprises an arm 22 which is pivotably mounted about a horizontal longitudinal axis 24 somewhat below the upper wall 14 at a lug of the side wall 12. The arm 22 has an upper supporting surface 26 of concave shape so that the ski S rests on the surface 26 only with the steel edges thereof. Two levers 28,30 pivotably connected by a pivot 36 form a knee lever arrangement, the upper lever 28 thereof pivotably connected with the arm 22 by a pivot 32 spaced from the axis 24, and the lower lever 30 thereof connected at the lower wall 16 by a pivot 34. A spring 38 urges the knee lever arrangement into the stretched position, whereby the arm 22 is horizontally supported. This is the supporting position of the arm 22 shown in the left half of FIG. 2.

The lower wall 16 has an oblong opening 40 through which snow can fall down. A pair of guide rails 42 are formed at the longitudinal edges of the opening 40. The guide rails 42 guide a guide block 44 which is reciprocated over substantially the whole length of the housing 10 by a spindle 46 which drivingly engages a thread hole 50 provided in a cross wall in the lower portion of the guide block 44. The ends of the spindle 46 are mounted for rotation in bearings (not shown) of the housing and one end is drivingly connected with an electric motor (not shown) arranged in a driving compartment 48 at one front end of the housing 10. The driving motor can be operated in opposite directions in order to reciprocate the guide block 44.

At the opposed lower side walls of the guide block 44 cams 52 are provided which co-operate with projections 55 provided at the lower levers 30 of the knee lever arrangements to swing that lower levers 30 outwards about the pivots 34 when the guide block 44 is moved axially. The levers 30 are swung into the position 30' shown in the right half of FIG. 2. The knee-lever arrangement 28, 30 thereby collapses and the supporting arm 22 is swung downwards and out of the moving path of the guide block 44 into the rest position 22'. When the guide block 44 has passed one pair of cross-wise opposed supporting elements 20 the latter are returned into their supporting positions by means of the springs 38.

Figure 3:
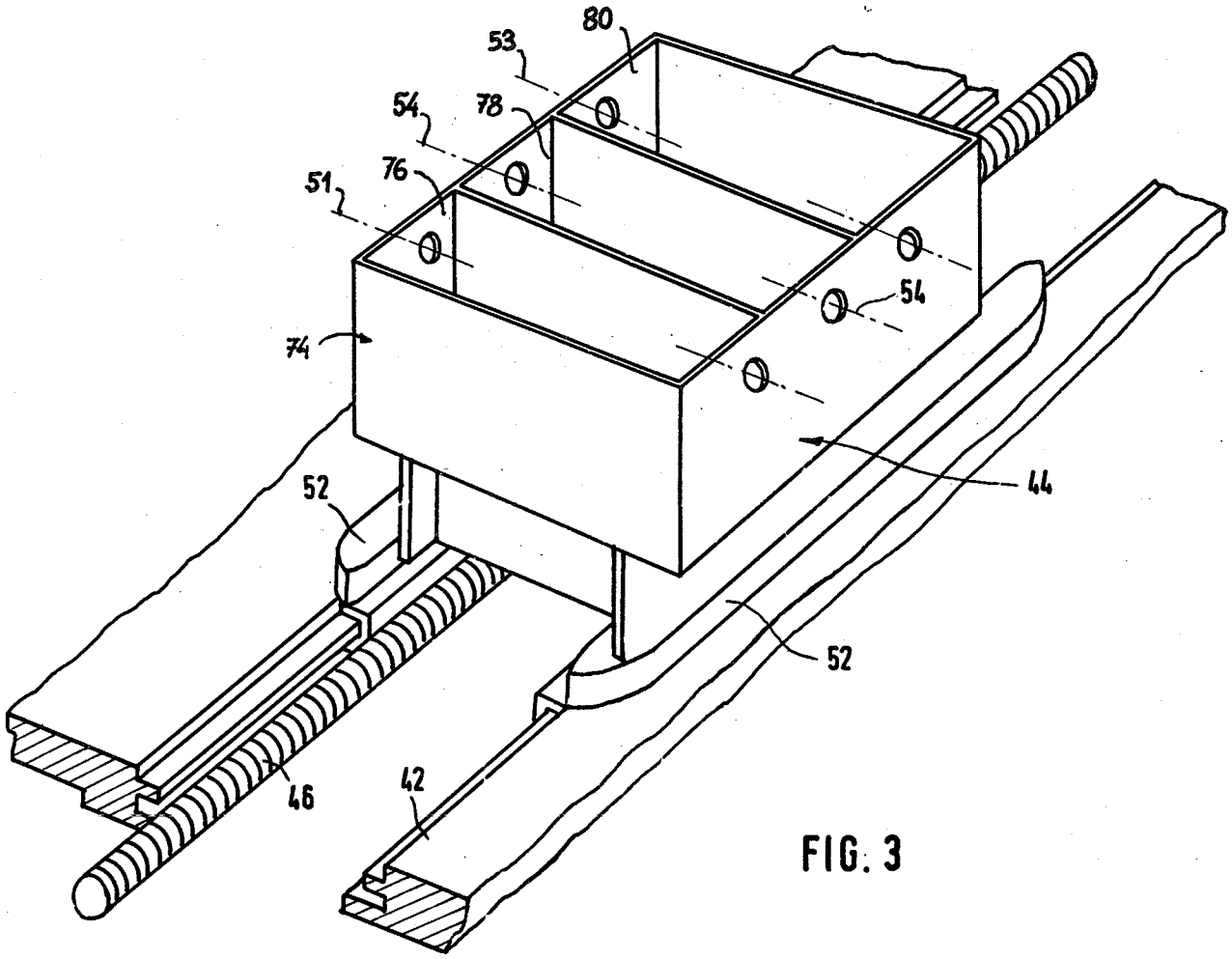
FIG. 3 is a perspective view of a movable guide block carrying a container with three compartements for mounting rotatable treatment brushes and rollers respectively.

It should be clear that if the length of the guide block 44 is smaller than the interspace between each two axially spaced pairs of supporting elements 20 only one pair of supporting elements in each moment is in the rest position so that all other supporting elements serve to support the skis S. As can be seen in FIG. 3 the cams 52 extend over the whole length of the guide block 44 and protrude beyond the ends thereof. Therefore the supporting elements 20 are operated during the forward motion of the guide block 44 and in the same way during the backward motion thereof.

A container 74 is mounted on the guide block 44 and comprises three compartments 76, 78, 80 one behind the other in axial or moving direction. In the compartment 76 a shaft 51 is rotatably mounted on which are fastened two blower units 57 spaced from one another to apply warm air streams to the running surfaces of the skis in order to melt snow. In the next compartment 78 in similar way a shaft 54 is rotatably mounted in the side walls of the container 74. Two brush roller units 56 are fastened on the shaft 54 with an interspace. The brush rollers serve to prepare the running surfaces of the skis for receiving a wax coating. In the third compartment 80 a shaft 53 is journaled on which are fastened two wax applying rollers 59, which immerse into a wax filling respectively. The compartment 80 is separated into a small central portion and a pair of opposite wax boxes by means of a pair of partition walls. On each of the shafts 51, 53, 54 a gear 58 is fastened between the pair of rollers respectively. The gears 58 mesh with an upper run 60 of an endless toothed belt the lower run 60' of which passes below the container 74. The endless toothed belt 60, 60' are guided by a pair of gears (not shown) at the opposed ends of the housing 10. One of that gears is driven by a driving motor to rotate the three rollers 56, 57, 59.

Figure 4:
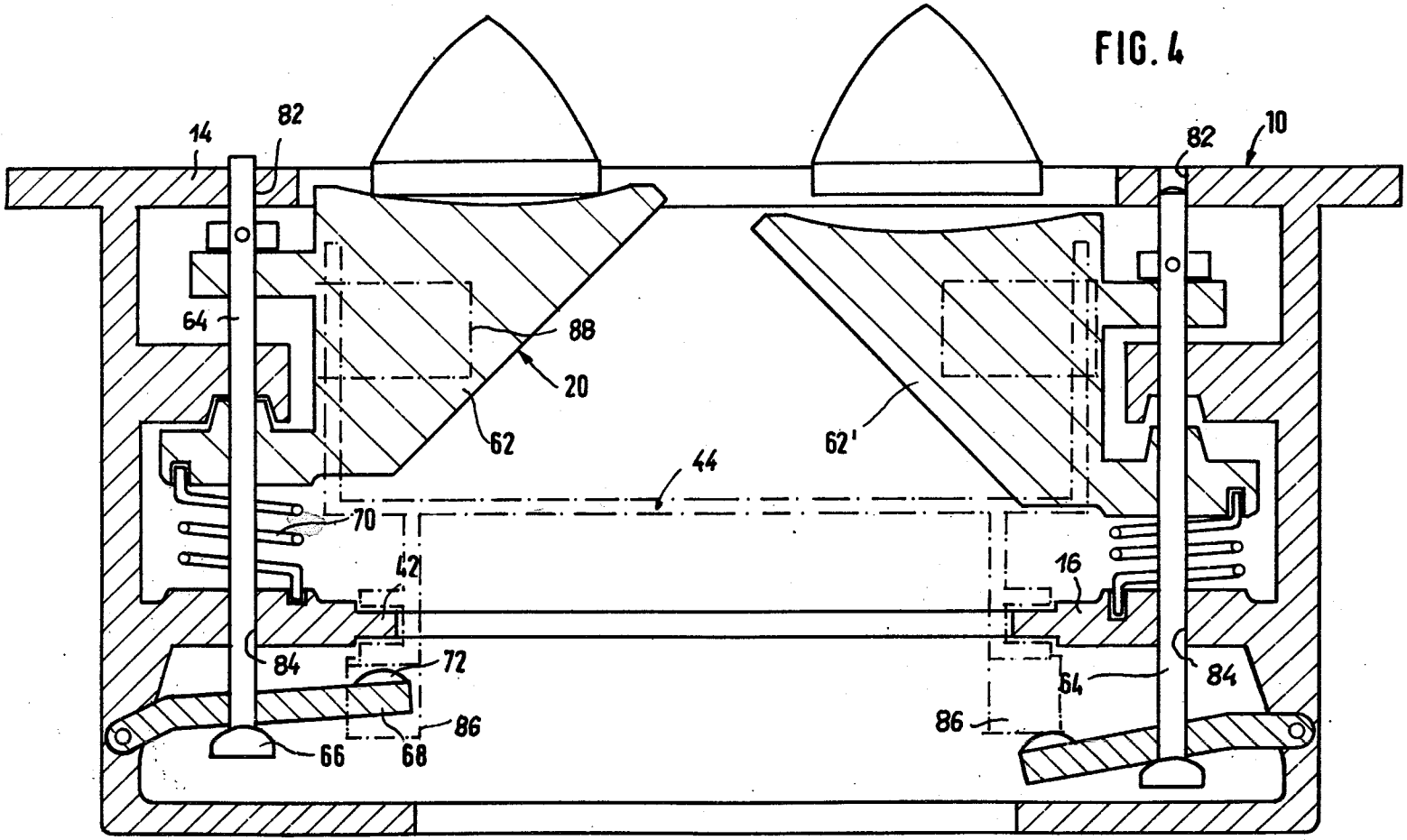
FIG. 4 is a cross-sectional view of another embodiment of the waxing machine.
Figure 5:
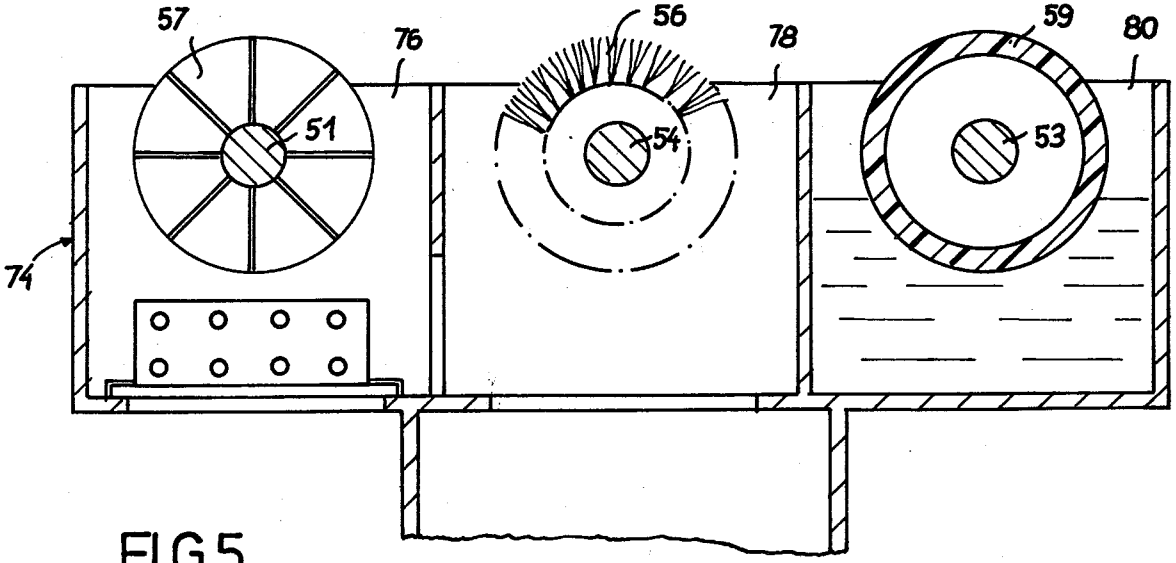
FIG. 5 is a longitudinal sectional view of the container mounted on the guide block with the treatment brushes and rollers in assembled positions.

FIG. 4 shows a modified embodiment of the supporting elements 20, which consist of cross-wise extending thin-walled plates 62, which are fastened on at least substantially vertical pivot rods 64, which are mounted for axial displacement and rotational movement in vertically aligned bores 82, 84 in the upper and lower walls of the housing 10. The pivot rods 64 project downwards beyond the lower wall 16 pass through operating flaps 68 and carry bottom heads 66. The operating flaps 68 are pivoted at the side walls and rest on the bottom heads 66. The inside ends of the operating flaps 68 are provided with projections 72 at the upper sides. The plates 62 are urged upwards into the supporting position by leg springs 70 which also provide a crosswise rest position of the plates 62. One leg of the spring 70 engages a hole of the plate 62 and the other leg engages a hole provided in the lower wall 16. The springs 70 surround the pivot rods 64 respectively. The guide block 44 schematically shown in FIG. 4 in dot and dashes has a pair of bottom cams 86 and a pair of side cams 88. The bottom cams 86 project in forward and backward directions beyond the side cams 88. Therefore when the guide block 44 approaches a pair of supporting plates 62 first the bottom cams 86 engage the projections 72 of the operating flaps 68 and move them downwards against the pressure of the springs 70 so that the supporting plates 62 are lowered in the position 62' and come free from the skis (right half of FIG. 4) and thereafter the side cams 88 serve to swing the plates about the axes of the pivot rods 64 into a substantially parallel position so that the guide block can pass between them.

Some modifications are within the scope of the invention. For example more than one guide block can be used in the form of a tandem arrangement in order to smooth and harden the wax coating. One guide block of the tandem arrangement can be provided with grinding wheels to grind the steel edges of the skis. The threaded spindle can be replaced by endless chains or cables and so on. But the main feature is that the skis remain stationary while the guide block runs along the lower sides of the skis and the supporting elements supporting the skis and the skier one after another for a short period are moved out of the moving path of the guide block while the rest of the supporting elements provide for sufficient support of the skis. Also the mechanical operation of the supporting elements can be replaced by electronic sensor means which detect the approach of the guide block and controls an operating device for moving the supporting elements.

I claim:

1. A ski waxing machine comprising an oblong housing, supporting elements arranged within said housing supporting the skis while being worn by the user, means for cleaning snow from the running surfaces of the skis, means for conditioning the running surfaces for receiving wax and means for applying a coating of wax, said means arranged in the housing, driving means for causing a relative movement in the longitudinal direction of the skis beween said skis and at least said means for applying a wax coating, said driving means comprising a guide block guided in the longitudinal direction within the housing for a reciprocating motion, at least said means for applying wax mounted at said guide block, said supporting elements provided in the moving path of the guide block and movably arranged between a supporting position inside of the moving path of the guide block and a rest position outside thereof respectively the supporting elements moved into their rest positions upon approach of the guide block respectively.

2. A ski waxing machine as claimed in claim 1, wherein for each one of a pair of skis a plurality of supporting elements are provided, at least one supporting element of said plurality of supporting elements is independently movably mounted with respect to at least one adjacent supporting element of the plurality of elements, and wherein the elements of both said plurality of elements extend crosswise to the longitudinal vertical central plane, and are mounted at their outside ends at the housing.

3. A ski waxing machine as claimed in claim 1 or 2, wherein each supporting element is pivotably mounted in such way as to be swung into its rest position downwards and away from the longitudinal vertical central plane of the housing.

4. A ski waxing machine as claimed in claim 3, wherein the supporting elements are mounted pivotably about longitudinal axes.

5. A ski waxing machine as claimed in claim 4, wherein at least one supporting element is mounted by means of a knee-lever arrangement taking its streched condition in the supporting position.

6. A ski waxing machine as claimed in claim 3, wherein at least one supporting element is axially displaceably mounted along and pivotably mounted about an at least substantially vertical axis and wherein the supporting element is spring-biased into an upper supporting position and first can be lowered by bottom cams of the guide block and thereafter can be swung aside by side cams of the guide block.

7. A ski waxing machine as claimed in claim 1 or 2, wherein each supporting element comprises a crosswise extending thin-walled plate or a cross-wise extending arm, the plate or arm being preloaded by spring means for self-resetting into the supporting position.

8. A ski waxing machine as claimed in claim 1, wherein the guide block is provided with cams for pushing against carrier or dog means of the supporting elements and wherein the cams are provided with a shape for a controlled movement of at least one supporting element after at least another one from the supporting position into the rest position thereof during the longitudinal movement of the guide block.

9. A ski waxing machine as claimed in claim 1, wherein each one of the supporting elements has an upper support surface which—as seen in the longitudinal direction of the housing—has a central portion on a lower level than opposite adjacent portions.

10. A ski waxing machine as claimed in claim 9, wherein the supporting surface—as seen in the longitudinal direction of the housing—is concavely shaped.

* * * * *